US007640731B2

(12) United States Patent
Huang

(10) Patent No.: US 7,640,731 B2
(45) Date of Patent: Jan. 5, 2010

(54) METHOD FOR CONTROLLING EXHAUST GAS FLOW AND TEMPERATURE THROUGH REGENERABLE EXHAUST GAS TREATMENT DEVICES

(75) Inventor: Yiqun Huang, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 469 days.

(21) Appl. No.: 11/805,035

(22) Filed: May 22, 2007

(65) Prior Publication Data

US 2008/0028748 A1 Feb. 7, 2008

Related U.S. Application Data

(63) Continuation of application No. 11/261,011, filed on Oct. 28, 2005, now Pat. No. 7,251,932.

(60) Provisional application No. 60/625,847, filed on Nov. 8, 2004.

(51) Int. Cl.
*F01N 3/00* (2006.01)

(52) U.S. Cl. ..... 60/297; 60/274; 60/280; 60/287; 60/288; 60/292; 60/295; 60/296; 60/324

(58) Field of Classification Search ..... 60/274, 60/278, 280, 287, 288, 290, 291, 292, 293, 60/295, 296, 297, 311, 324
See application file for complete search history.

(56) References Cited

U.S. PATENT DOCUMENTS

| | | | | |
|---|---|---|---|---|
| 5,067,319 | A * | 11/1991 | Moser | 60/288 |
| 5,937,637 | A * | 8/1999 | Fujishita et al. | 60/274 |
| 6,212,885 | B1 * | 4/2001 | Hirota et al. | 60/288 |
| 6,779,339 | B1 * | 8/2004 | Laroo et al. | 60/297 |
| 7,040,087 | B2 * | 5/2006 | Nakatani et al. | 60/286 |
| 7,343,736 | B2 * | 3/2008 | Kalish | 60/288 |

* cited by examiner

*Primary Examiner*—Binh Q Tran
(74) *Attorney, Agent, or Firm*—Gunn & Lee, P.C.

(57) ABSTRACT

A reconfigurable exhaust system provides selective positioning of exhaust gas treatment devices either near, or spaced from, the exhaust gas outlet port of a turbine of a turbocharged Diesel engine. In some embodiments, auxiliary air or a heat exchanger are arranged to cool the exhaust gas when required.

15 Claims, 7 Drawing Sheets

METHOD FOR CONTROLLING EXHAUST GAS FLOW AND TEMPERATURE THROUGH REGENERABLE EXHAUST GAS TREATMENT DEVICES

This is a continuation application U.S. patent application Ser. No. 11/261,011, filed Oct. 28, 2005 now U.S. Pat. No. 7,251,932, which claims priority to U.S. Provisional Application Ser. No. 60/625,847 filed Nov. 8, 2004.

BACKGROUND OF THE INVENTION

1. Technical Field

This invention relates generally to an exhaust system having a controllably variable flowpath for exhaust gas circulation, and more particularly to the use of such a system to control exhaust gas flow through regenerable exhaust gas treatment devices.

2. Background Art

Worldwide emissions regulations slated for introduction in the near future impose very stringent emissions regulations. The Tier 2 regulations in the United States require that Diesel vehicles have the same ultra-low emissions levels as spark ignited vehicles. Moreover, Tier 3 requirements, which phase in for different engine levels over the next three years call for a 40% reduction in $NO_x$ (oxides of nitrogen) from the Tier 2 levels now in existence.

Various combustion modes, directed to addressing both in-cylinder (engine-out) and exhaust gas treatment device requirements, have been proposed. For example, U.S. Pat. No. 5,732,554, issued Mar. 31, 1998 to Shizuo Sasaki, et al. for an EXHAUST GAS PURIFICATION DEVICE FOR AN INTERNAL COMBUSTION ENGINE describes a method by which the normal fuel lean operating mode of an engine is switched to a rich premixed charge compression ignition, more accurately and preferably referred to as premixed controlled compression ignition (PCCI), combustion mode.

U.S. Pat. No. 5,937,639 granted Aug. 17, 1999 to Shizuo Sasaki, et al. for INTERNAL COMBUSTION ENGINE describes an alternative method for lowering the combustion temperature, i.e., low temperature combustion (LTC) to minimize smoke generation during rich, or near rich, combustion. LTC and PCCI combustion are alternative combustion modes which normal Diesel lean combustion can be transitioned to during engine operation.

Perhaps of most concern to the Diesel engine market are the proposed very tight future reductions in terms of oxides of nitrogen ($NO_x$) and particulate matter (PM) emissions. One of the most promising technologies for $NO_x$ treatment is $NO_x$ absorbers, also known as "lean $NO_x$ traps." Diesel particulate filters, also known as Diesel particulate traps, and lean $NO_x$ traps are the most likely, at least in the foreseeable future, means by which emissions will be reduced. Lean NOx traps and Diesel particulate filters need to be regenerated periodically to restore their efficiencies. The regeneration of lean $NO_x$ traps is usually done by providing reductants, such as CO and HC under oxygen-free conditions. A regenerated lean $NO_x$ trap not only adsorbs $NO_x$ emissions, but also adsorbs sulfur carried in the exhaust gas stream. Sulfur removal (desulfation) must be undertaken at a temperature above 600° C. under oxygen-free conditions, i.e., combustion of a stoichiometric or richer air/fuel ratio. Under typical Diesel lean combustion operation, such very high temperatures cannot normally be obtained except under very high load conditions. Diesel particulate filter regeneration is carried out by oxidizing soot and other particles "trapped" in the Diesel particulate filter at a high temperature and a lean air/fuel ratio.

Frequent lean $NO_x$ trap (LNT) regeneration is necessary when the engine-out $NO_x$ is high, for example, when operating under high loads, but frequent generation at higher loads can cause the temperature of the LNT to increase rapidly. The rapid temperature increase results from the exothermic reaction associated with the rich combustion products carried in the exhaust that are used to regenerate the LNT. Diesel particulate filters (DPF) also require high temperature to be regenerated. When the LNT is located downstream of the DPF, the exothermic reaction taking place in the DPF during regeneration will result in an increase in the outlet exhaust gas temperature of the DPF. The LNT inlet exhaust gas temperature is therefore also increased. When the temperature of the LNT increases above a critical temperature, as a result of the frequent regeneration of the LNT or the regeneration of the DPF, the absorption efficiency of $NO_x$ by the LNT is very low and tailpipe $NO_x$ emissions accordingly are high.

The present invention is directed to overcoming the problems set forth above with respect to the critical temperature requirements associated with catalyzed and other exhaust gas after treatment device operation and regeneration. It is desirable to have an exhaust system in which LNTs, selective catalytic reduction (SCR) catalysts, and like regenerable exhaust gas treatment devices can be optimally positioned within the exhaust system to provide efficient operation over a wide range of engine operating conditions and regeneration requirements. It is also desirable to have a flexible exhaust system in which the exhaust gas flowpath can be selectively varied to control regeneration temperatures to meet differing operation and regeneration requirements. It is also desirable to have a method by which LNT temperature can be managed for the best efficiency during cold start, regeneration and DPF regeneration. It is also desirable to have an exhaust system and method of temperature control by which unregulated emissions can be reduced by management of the exhaust gas temperature passing through various components of the exhaust system.

SUMMARY OF THE INVENTION

In accordance with one aspect of the present invention, an exhaust system having a variable flowpath has a three-way engine-out exhaust control valve adapted to direct exhaust gas flow through selectable first and second outlet ports. A regenerable gas treatment device has an inlet in direct communication with the first outlet port of the three-way engine-out exhaust control valve, and a second exhaust gas treatment device has an inlet in direct communication with the second outlet port of the three-way engine-out exhaust control valve. A second three-way exhaust control valve has a first inlet port in communication with the outlet of the second exhaust gas treatment device, and a second inlet port in communication with the inlet of the regenerable exhaust gas treatment device. The second three-way exhaust control valve has an outlet port in direct communication with the ambient environment. A third three-way exhaust control valve has an inlet port in direct communication with the outlet of the regenerable exhaust gas treatment device.

Other features of the exhaust gas system embodying the present invention, include a third exhaust gas treatment device having an inlet in direct communication with the outlet of the second exhaust gas treatment device.

In accordance with another aspect of the present invention, a method for controlling exhaust gas flow through a regenerable exhaust gas treatment device includes passing exhaust gas through a relatively short passageway from the engine to an inlet of the regenerable exhaust gas treatment device by which the internal temperature of the regenerable exhaust gas treatment device, during engine operation, is maintained above a predetermined low temperature. The method further includes sending exhaust gas produced by the engine through a relatively longer second exhaust duct to the regenerable gas treatment device by which the internal temperature of the regenerable exhaust gas treatment device, during engine operation, is maintained below a predefined high temperature.

Other features of the method for controlling exhaust gas flow through a regenerable exhaust gas treatment device, in accordance with the present invention, includes passing exhaust gas produced by the engine through a relatively shorter first exhaust duct when the engine is operating in a low to light load condition, and through the relatively longer second duct when the engine is operating in a medium to high load condition.

Yet another feature of the method for controlling exhaust gas flow through a regenerable exhaust gas treatment device, embodying the present invention, includes passing exhaust gas produced by the engine through the relatively short first exhaust duct during cold start-up of the engine.

BRIEF DESCRIPTION OF THE DRAWINGS

A more complete understanding of the exhaust system and method for controlling exhaust gas flow through a regenerable exhaust gas after treatment device, in accordance with the present invention, may be had by reference to the following detailed description when taken in conjunction with the accompanying drawings, wherein.

DETAILED DESCRIPTION OF THE PREFERRED EMBODIMENTS

At cold start, the best way to increase LNT substrate temperature is to increase the exhaust gas temperature so that hot exhaust gas will quickly heat the LNT and raise its substrate temperature. In addition to using in-cylinder or external means to increase exhaust gas temperature as fast as possible, such as by increasing engine idle speed, increasing exhaust back pressure whereby engine load is increased at idle, retarding combustion so that the exhaust temperature will be higher, or by electrical heating, optimizing the location of each treatment device in the exhaust system is also very important.

Ideally, an LNT should be positioned as close as possible to the exhaust manifold or turbocharger outlet so that the exhaust gas will heat the LNT first. However, a close-coupled LNT will have lower efficiency at higher engine loads when the LNT has warmed up, increasingly high LNT substrate temperatures will result in a reduced capability to the LNT to absorb $NO_x$ emissions. When the LNT is mounted remotely, i.e., further away, from the turbocharger outlet, it is easier to maintain the LNT substrate temperature for best efficiency under most speed-load condition after the LNT warms up. However, the remote location also contributes to cool-down of the LNT during low or light load conditions and, accordingly, the LNT will lose its conversion efficiency.

In the following description of preferred embodiments of the present invention, a flexible configuration of exhaust gas treatment system components permits the functional location of the LNT, or other after treatment device, in the exhaust system to be readily changed by controlling the exhaust gas flowpath. A close-coupled LNT can be provided for fast warm-up during cold start and warming up operation and LNT substrate temperatures can be maintained within a desirable temperature range under light load engine operation. By lengthening the exhaust gas flowpath and behind other components of exhaust gas treatment system, the LNT can be advantageously positioned for optimum efficiency under higher engine speed and load operation.

Figure 1:
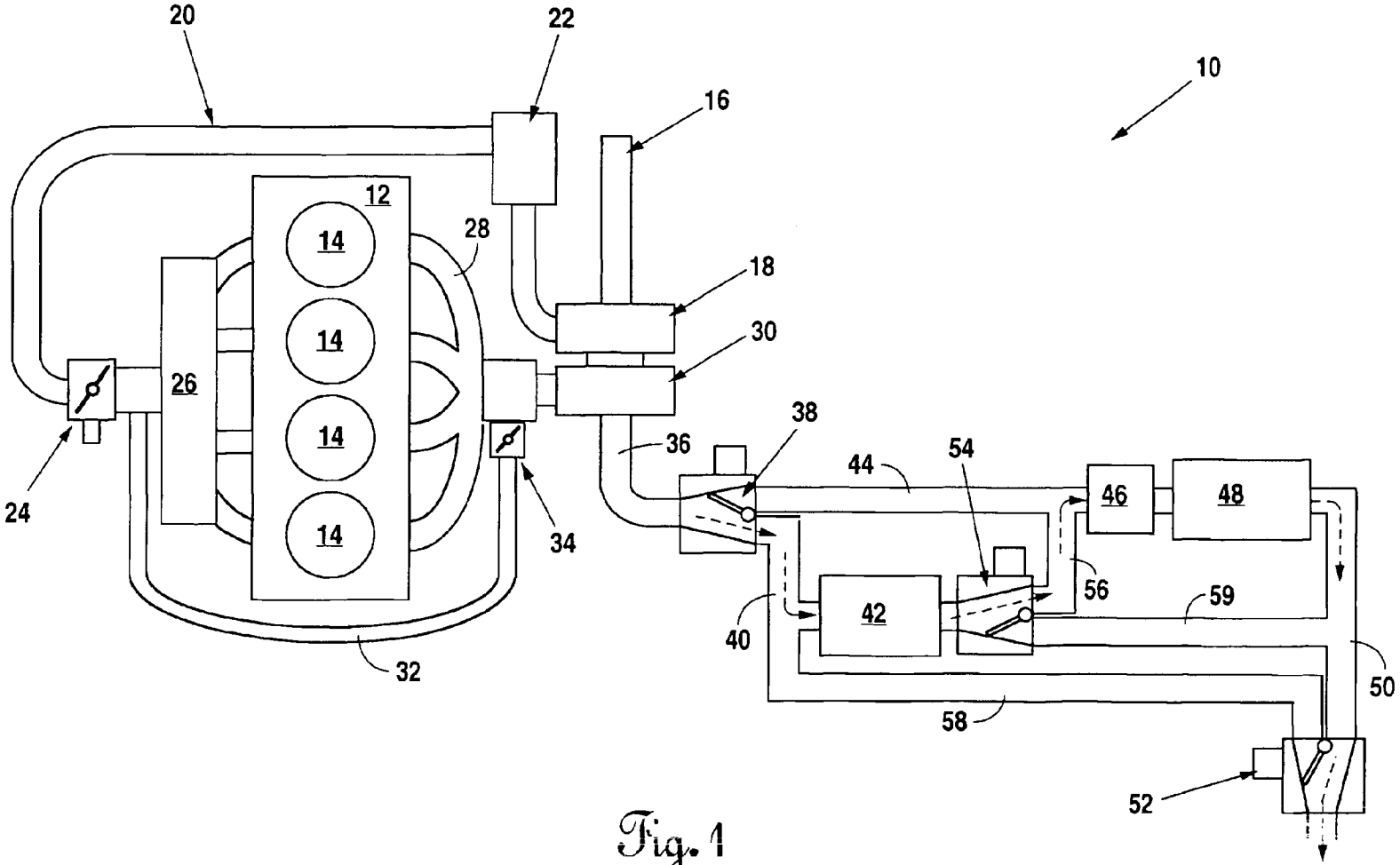
FIG. 1 is a schematic diagram of an exhaust treatment system embodying the present invention, showing the controlled flowpath of exhaust gas during cold start and warm-up.

The first embodiment of the present invention is illustrated in FIG. 1. In this embodiment, the lean $NO_x$ trap is close-coupled to the engine exhaust manifold, a position particularly desirable during cold start and warm-up periods as well as for maintenance of the LNT substrate temperatures under light engine load operation.

As shown in FIG. 1, an exhaust gas treatment system 10 embodying the present invention provides a controllably variable flowpath for exhaust gas produced by a Diesel engine 12. The Diesel engine 12 has a plurality of combustion chambers 14 and an intake air duct 16 in communication with the intake port of a compressor 18. The compressor 18 provides compressed air to a boost air duct 20 having an inter-cooler 22 positioned between the compressor 18 and an intake throttle valve 24 which regulates, or controls, the flow of intake air into an intake manifold 26. An exhaust manifold 28 is connected to the inlet port of a turbine 30. The engine 12 also has an exhaust gas recirculation duct 32 by which controlled amounts of exhaust gas may be recirculated from the exhaust manifold 28 into the intake manifold 26. The amount of recirculated exhaust gas is controlled by an exhaust gas recirculation valve 34.

The exhaust system 10 has a three-way engine-out exhaust valve 38 positioned in close proximity to the turbine 30. A conduit 36, preferably having a very short length, extends between an outlet of the turbine 30 and an inlet port of the three-way engine-out exhaust valve 38. If desired, the three-way engine-out exhaust valve 38 could even be mounted directly on the outlet of the turbine 30. The three-way engine-out exhaust valve 38 has first and second outlet ports arranged so that the valve can controllably direct all, or portions, of the exhaust gas flow through either of the outlet ports.

A first exhaust duct 40, also preferably having a short length, extends between the first outlet port of the three-way engine-out exhaust valve 38 and an inlet to a regenerable exhaust gas treatment device 42 which, for the purpose of illustrating the present invention, is a lean $NO_x$ trap. A second exhaust duct 44 extends between the second outlet port of the three-way engine-out exhaust valve 38 and a second exhaust gas treatment device 46, for example, a Diesel oxidation catalyst. In the illustrated embodiments, the exhaust gas treatment system 10 also has a third exhaust gas treatment device 48, such as a Diesel particulate filter. A third exhaust duct 50 provides fluid communication between an outlet of the Diesel particulate filter 48 and a first inlet port of a second three-way exhaust valve 52. An outlet port of the second three-way exhaust valve 52 provides direct communication with the ambient environment. A third three-way exhaust valve 54 has an inlet port in direct communication with an outlet of the lean $NO_x$ trap 42. A fourth exhaust duct 56 extends from a first outlet port of the third three-way exhaust valve 54 to the second exhaust duct 44. A fifth exhaust duct 58 extends from the inlet of the LNT 42 to the second inlet port of the second three-way exhaust valve 52. A sixth exhaust duct 59 extends from a second outlet port of the third three-way exhaust valve 54 to the third exhaust duct 50.

During cold start and warm-up if an engine control unit, not shown, detects temperatures in the LNT 42 that are less than a predefined lower value, the configuration of the flexible exhaust system 10, illustrated in the FIG. 1 embodiment, will provide fast warm-up of the LNT 42, as illustrated by arrows indicating the direction of exhaust flow. Exhaust gas discharged from the outlet of the compressor 30 is directed through the three-way engine-out exhaust valve 38 directly to the inlet of the LNT 42. The flexible exhaust system 10 is configured in this embodiment in such a manner that the exhaust gas exiting the LNT 42 is directed, as indicated, through the third three-way exhaust valve 54, the fourth exhaust duct 56, and the second exhaust duct 44 to the inlet of the Diesel oxidation catalyst 46. Exhaust gas flow continues from the outlet of the Diesel oxidation catalyst 46 to the inlet of the Diesel particulate filter 48, and then from the outlet of the Diesel particulate filter 48 and through the third exhaust duct 50 to the first inlet port of the second three-way exhaust valve 52 and subsequently into the ambient environment. The configuration provided by the first embodiment assures that the LNT is the closest exhaust system component to the outlet of the turbocharger.

Figure 2:
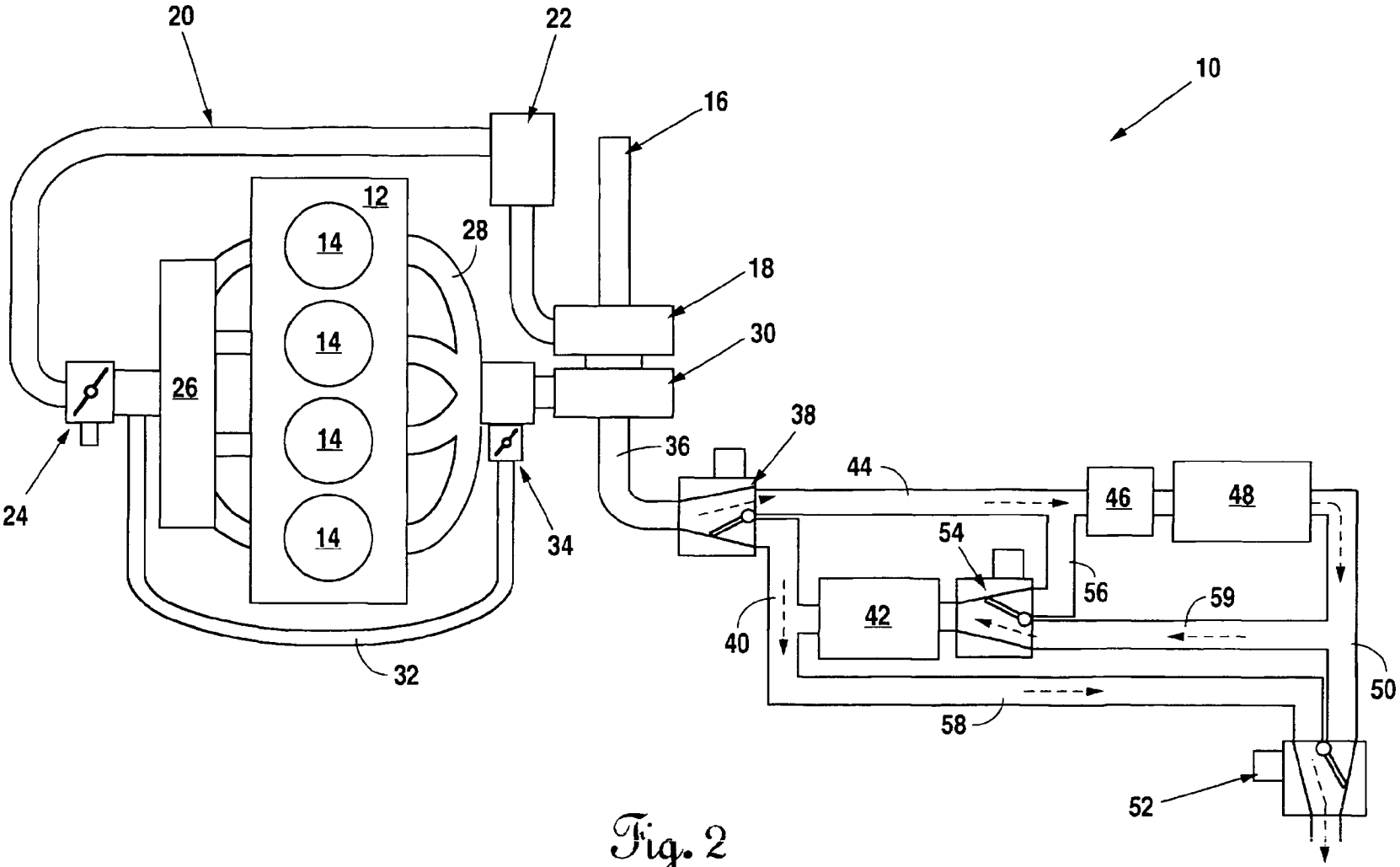
FIG. 2 is a schematic diagram of the exhaust treatment system embodying the present invention, showing the controlled flowpath of exhaust gas during normal engine operation.

Under normal operating conditions, the flexible exhaust system 10 embodying the present invention is reconfigured to the arrangement illustrated in FIG. 2. In this embodiment, the LNT 42 is desirably remotely positioned from the outlet of the turbine 30. As indicated by the exhaust flow arrows, exhaust gas discharged from the turbine 30 is directed through the second outlet port of the three-way engine-out exhaust valve 38 and then through the second exhaust duct 44 to the inlet of the Diesel oxidation catalyst 46. After passing through the Diesel oxidation catalyst 46, the Diesel particulate filter 48, and a portion of the third exhaust duct 50, the exhaust is directed through the sixth exhaust duct 59 and the second inlet port of the third three-way exhaust valve 54 into the LNT 42. From the LNT 42, the exhaust gas is directed through the fifth exhaust duct 58 to the second inlet port of the second three-way exhaust valve 52, and thence into the ambient environment.

During low to light load operation, if the LNT temperature is less than a desired minimum LNT efficiency temperature, the variably configurable exhaust system 10 directs the flow of exhaust gas through the close-coupled LNT configuration shown in FIG. 1, so that the hotter exhaust gases will be provided to the LNT 42. When the internal temperature in the LNT 42 is sufficiently high, the three-way engine-out exhaust valve 38 is controllably switched to the normal operating position, illustrated in FIG. 2, by which the exhaust gas is directed first to other treatment devices and then lastly to the LNT.

During regeneration of the LNT 42, the close-coupled configuration illustrated in FIG. 1 is particularly useful in enabling fast air/fuel ratio switching. Increased regeneration efficiency also requires fewer reductants, such as CO and HC during regeneration and the breakthrough of CO and HC from LNT 42 can be treated by the oxidation catalyst 46, and the subsequent treatment of these reductants in the Diesel oxidation catalyst 46 of the Diesel particulate filter 48 is greatly reduced. Moreover the fuel penalty generally attendant with regeneration is reduced and drivability is improved as a result of more efficient and fewer required LNT regeneration cycles. Importantly, the variably configurable exhaust system 10 embodying the present invention permits alternate operation between the LNT close-coupled configuration illustrated in FIG. 1 and the LNT remotely mounted configuration shown in FIG. 2. Importantly, alternate operation between the two configurations enables the LNT 42 to be thoroughly regenerated alternately from both sides.

During LNT regeneration, the regeneration frequency, duration and air/fuel ratio are determined by a specific regeneration strategy that is a function of engine-out $NO_x$ emissions and current engine operating conditions. At high load, due to the high engine-out $NO_x$ emissions, regeneration must be carried out at more frequent intervals. Accordingly, the temperature of the LNT 42 increases rapidly if the period between two adjacent regenerations is not long enough for the LNT substrate temperature to be cooled. The only way to reduce the internal temperature of the LNT is to cool down the exhaust gas entering the LNT between two consecutive LNT regenerations. Ways in which the exhaust gas can be cooled during LNT regeneration are discussed below in the embodiments illustrated in FIGS. 3-6.

During LNT desulfation at high load operation, in which PCCI is the preferred combustion mode for increasing LNT temperature while providing exhaust gas consisting of products of stoichiometric combustion for regeneration of the LNT 42, in the remotely-mounted LNT configuration illustrated in FIG. 2 the DPF 48 is desirably positioned in front of the LNT 42 thereby permitting DPF regeneration only during the lean combustion period. However, the DPF 48 will collect particulate matter during the rich combustion period, and therefore LNT desulfation and DPF regeneration cannot be desirably carried out simultaneously under the remote mounted configuration of FIG. 2. In the readily reconfigurable exhaust system 10 embodying the present invention, by switching the reconfigurable exhaust system to the closed coupled configuration, the LNT 42 is desirably positioned before the Diesel oxidation catalyst 46 and the Diesel particulate filter 48, and as shown in subsequently described embodiments, external air can be introduced before the Diesel oxidation catalyst 46 and/or the Diesel particulate filter 48 to provide abundant oxygen during the LNT desulfation process. Thus, by introducing external air upstream of the Diesel oxidation catalyst 46 and/or the Diesel particulate filter 48, the exhaust gas fed into the Diesel particulate filter 48 can always be lean regardless of whether or not the exhaust gas fed into the LNT 42 is rich or lean.

Figure 3:
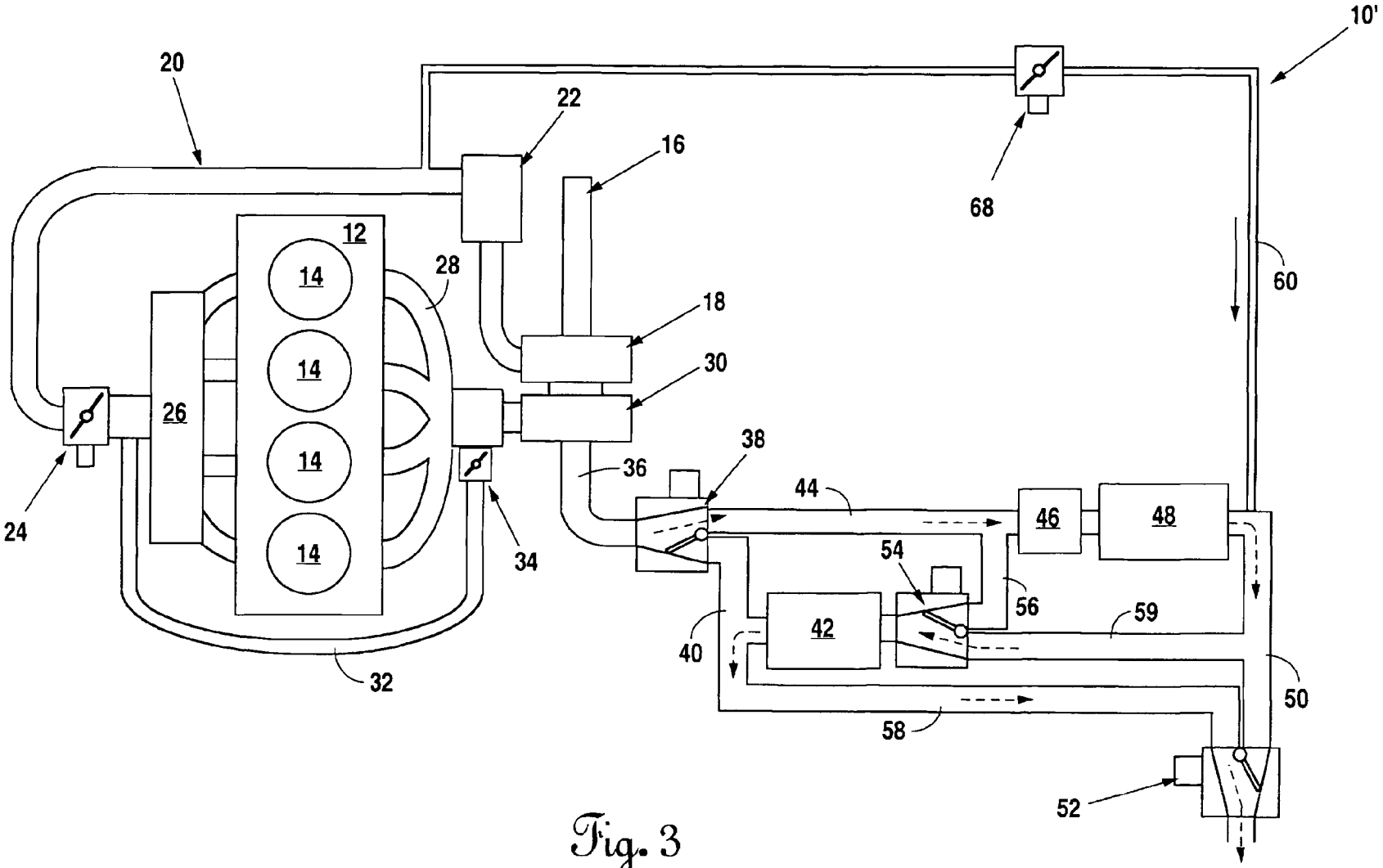
FIG. 3 is a schematic diagram of the exhaust treatment system embodying the present invention, showing the controlled flowpath of exhaust gas at high load engine operation, using cooled auxiliary air to regulate the exhaust gas temperature.

The variably reconfigurable exhaust system 10 embodying the present invention, provides at least two methods by which exhaust gas temperature can be cooled down between consecutive LNT regenerations. FIG. 3 illustrates an embodiment of the variably reconfigurable exhaust system 10_in which the internal temperature of the LNT 42 can be controlled during high load engine operation by introducing cooled auxiliary air through an auxiliary air conduit 60 extending between the boost air duct 20 and third exhaust duct 50. The flow of auxiliary air through the auxiliary air conduit 60 is controlled by an auxiliary air control valve 68. Thus, between regenerations, external low temperature air can be used to dilute the exhaust gas entering the LNT 42, enabling the internal temperature of the LNT to be lowered. The addition of auxiliary air must be interrupted prior to the next regeneration period to prevent dilution of the rich exhaust gas needed for $NO_x$ conversion, i.e., LNT regeneration.

Figure 4:
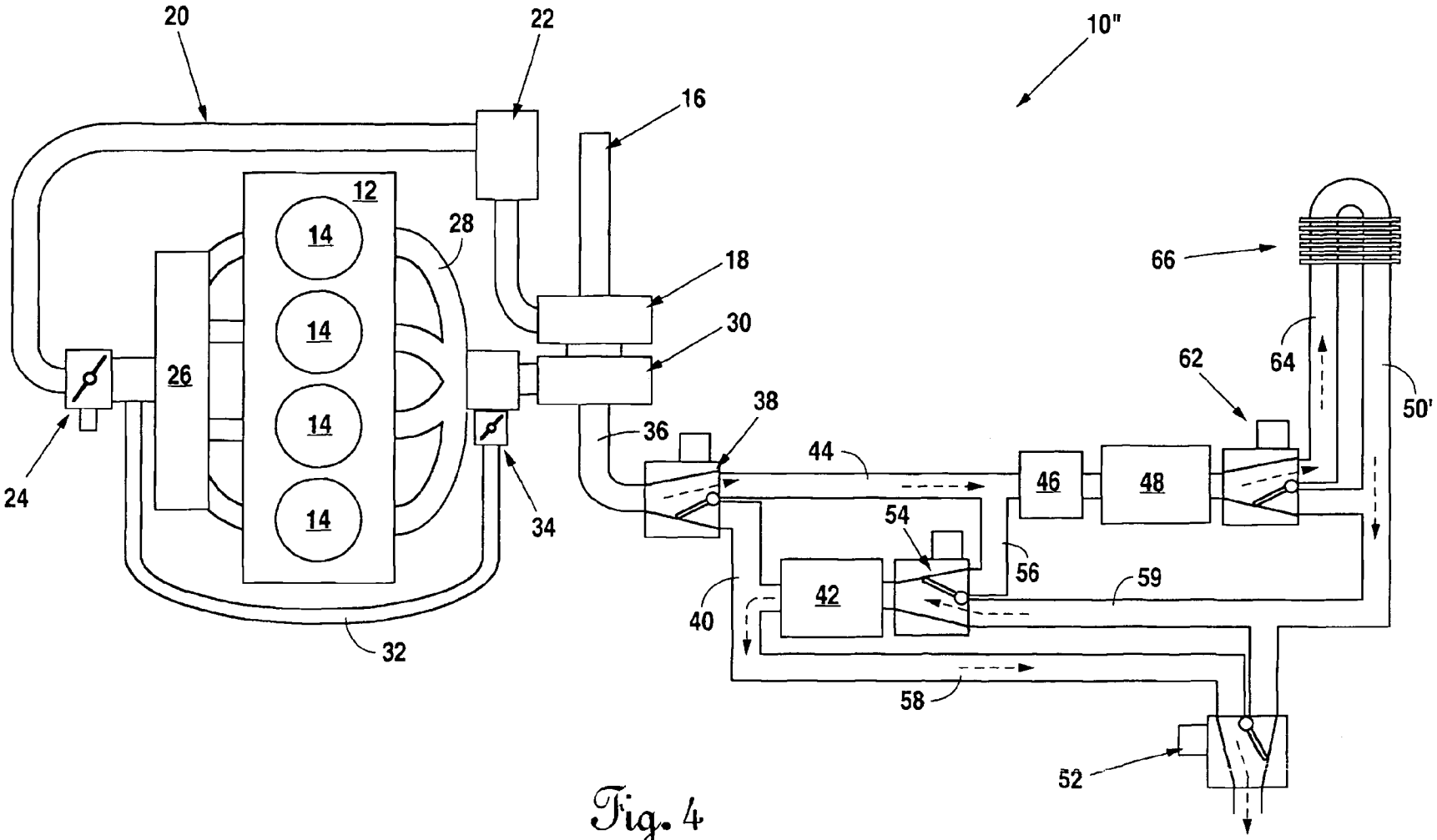
FIG. 4 is a schematic diagram of the exhaust treatment system embodying the present invention, showing the controlled flowpath of exhaust gas at high load engine operation, in which an exhaust cooler is used to regulate the temperature of the exhaust gas.

FIG. 4 illustrates another embodiment of the readily reconfigurable exhaust system 10" embodying the present invention in which the thermal management of the LNT 42 during high load engine operation is enabled by the use of an exhaust cooler 66. In this embodiment, a fourth three-way exhaust valve 62 has an inlet port in direct communication with the outlet of the DPF 48. A seventh exhaust duct 64 extends from a first outlet port of the fourth three-way exhaust valve 62 to an inlet of the exhaust cooler 66. The outlet exhaust gas flows out of the exhaust gas cooler through a modified third exhaust duct 50' and then through the sixth exhaust duct 59 and through the third three-way exhaust valve 54 to the LNT 42. After passing through the LNT 42, the exhaust gas is directed through the fifth exhaust duct 58 to the second intake port of the second three-way exhaust valve 52, and subsequently discharged into the ambient environment. During LNT $NO_x$ regeneration, directing exhaust gas through the exhaust cooler 66 provides cooler exhaust gas to lower the internal temperature in the LNT between regenerations.

Figure 5:
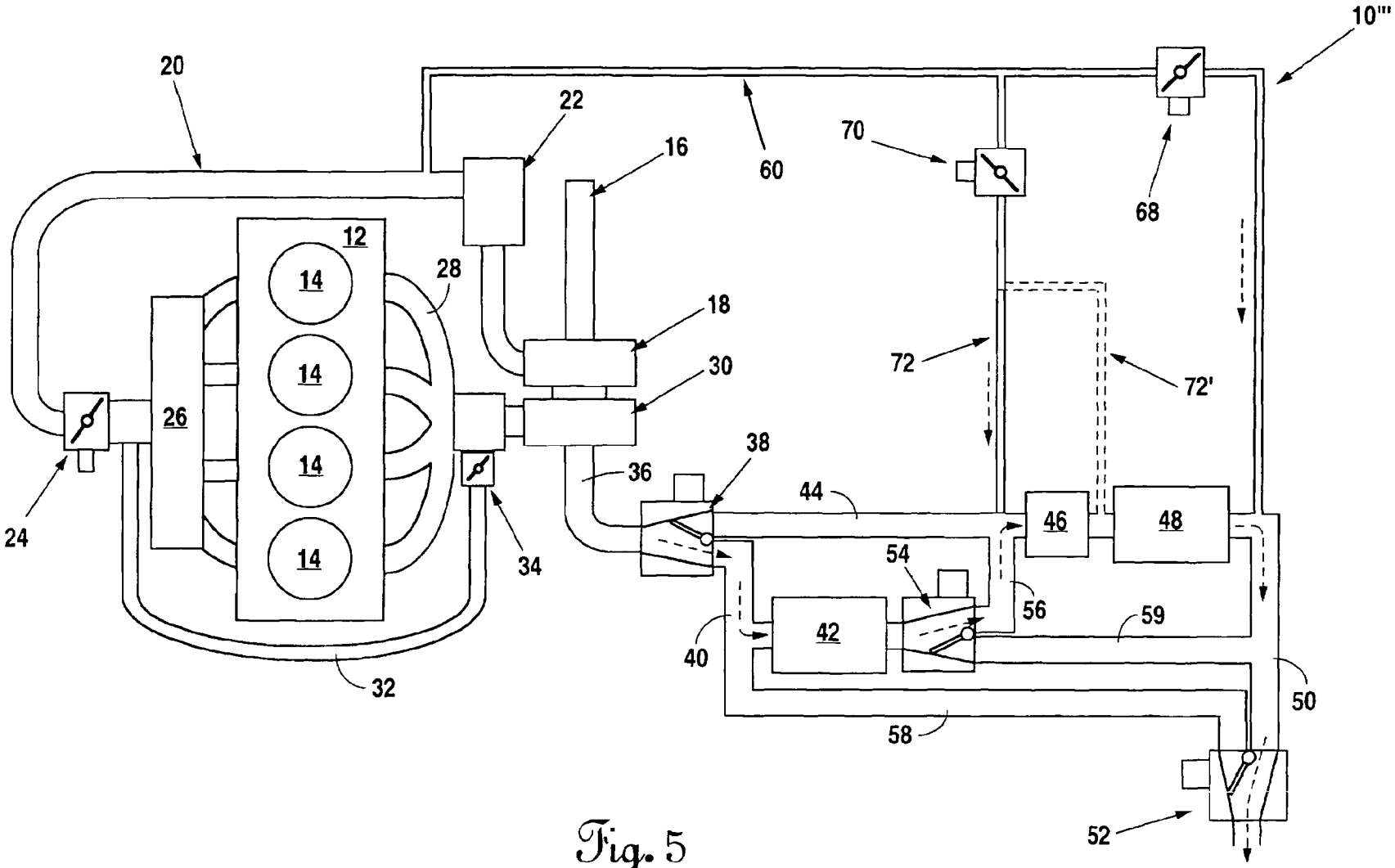
FIG. 5 is a schematic diagram of the exhaust treatment system embodying the present invention, showing the controlled flowpath of exhaust gas during simultaneous regeneration Diesel particulate filter and desulfation of a lean $NO_x$ trap.

FIG. 5 illustrates a fourth embodiment of the configurable exhaust system 10" embodying the present invention. In this embodiment, the second auxiliary air conduit 72 extends between the first auxiliary air conduit 60 and the second exhaust duct 44 at a position adjacent the inlet to the Diesel oxidation catalyst 46 in which auxiliary air can be introduced before the Diesel particulate filter 48 during rich combustion operation for desulfation of the LNT 42. Auxiliary airflow through the second auxiliary air conduit 72 is controlled by a second auxiliary air control valve 70. If desired, the auxiliary air may be conducted through an alternately positioned second auxiliary air conduit 72' to provide auxiliary air to the inlet of the Diesel particulate filter 48.

Figure 6:
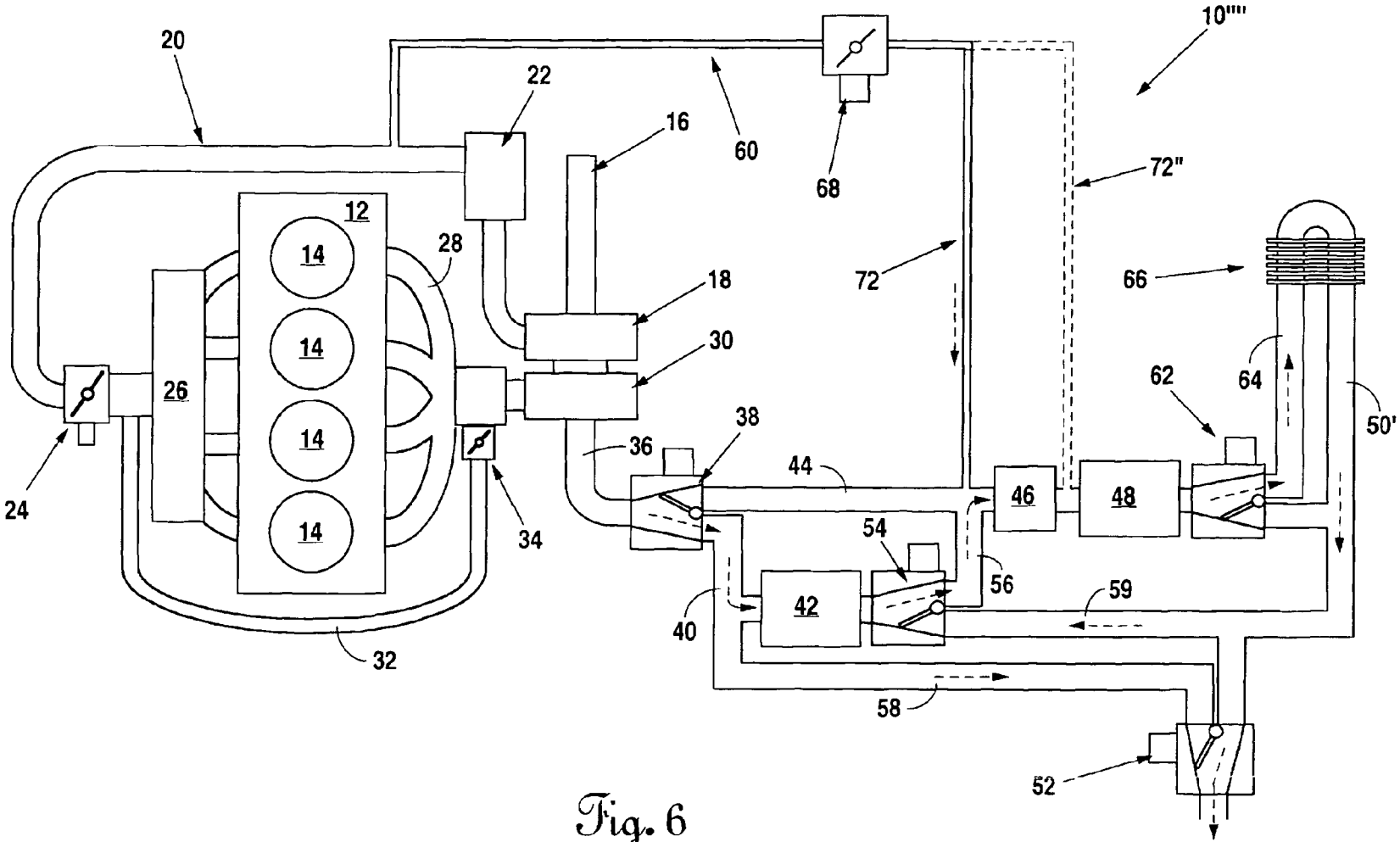
FIG. 6 is a schematic diagram of the exhaust gas treatment system embodying the present invention, showing an alternate controlled pathway for exhaust gas during simultaneous regeneration of a lean $NO_x$ trap and a Diesel particulate filter.

FIG. 6 illustrates a fifth embodiment of the variably configurable exhaust system 10" embodying the present invention in which auxiliary air can be introduced before the Diesel particulate filter 48 during rich combustion operation for desulfation of the LNT 42. In this configuration, the exhaust cooler 66 can provide additional exhaust gas cooling prior to introduction into the LNT 42 if desired.

Figure 7:
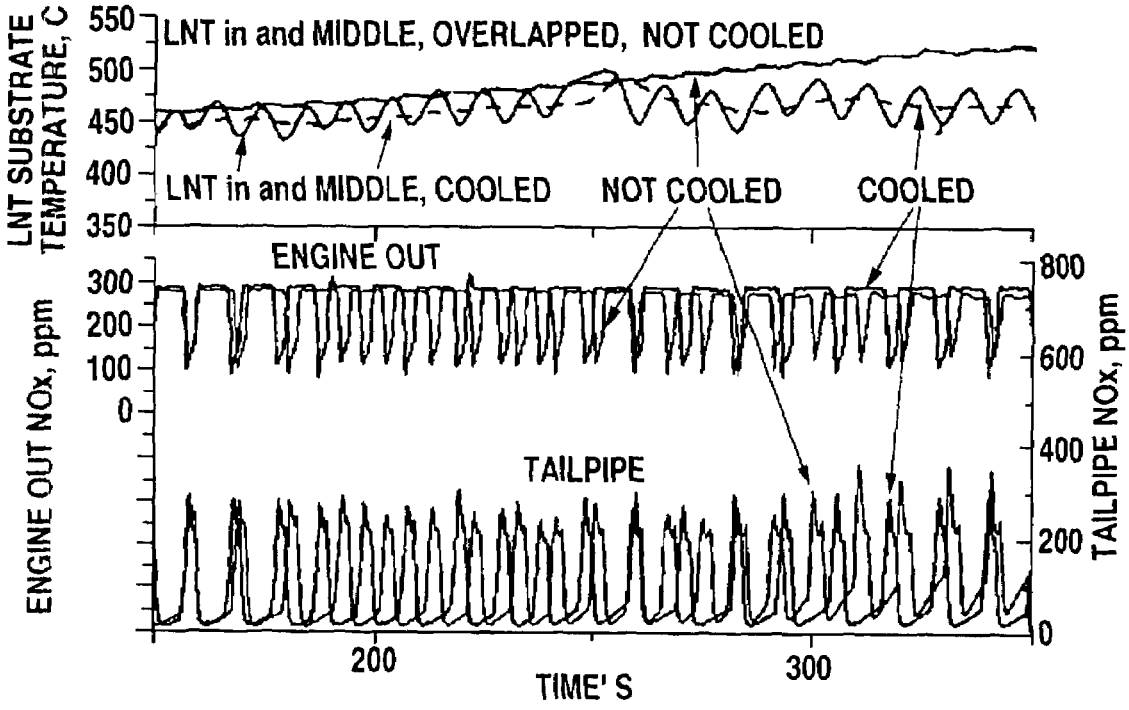
FIG. 7 is a graphical representation of exhaust gas temperatures at various locations in the exhaust treatment system, illustrating thermal management of exhaust temperatures by auxiliary air injection.

FIG. 7 illustrates the effectiveness of the variably configurable exhaust system embodying the present invention in providing control of LNT temperature at high load conditions. In the upper portion of the graph, labeled LNT substrate temperature, ° C. without auxiliary air injection, the LNT substrate temperatures, i.e., inlet center line and middle center line overlap with each other, represented by the solid thin line rises to a temperature above 500° C. and keeps increasing during regeneration. However, with auxiliary air injection between successive regenerations, the LNT inlet center line substrate temperature represented by the heavy solid line, the LNT middle center line substrate temperatures represented by the thin dash line can be maintained at a temperature below 500° C.

Moreover, as illustrated in the lower portion of the FIG. 7 graph, during regeneration, auxiliary air injection significantly reduces the tailpipe $NO_x$ emissions. The spikes in tailpipe $NO_x$ indicated as cooled when auxiliary air is injected, is measurably less than the spikes in the absence of auxiliary air injection. From the foregoing discussion, it can be seen that the variably configurable exhaust system embodying the present invention provides a readily configurable exhaust flowpath that can be changed as required by different engine operating conditions.

Although the present invention is described in terms of preferred illustrative embodiments, those skilled in the art will recognize that variations on, or combinations of, the described embodiments can be made in carrying out the present invention. For example, LNT desulfation can be carried out in the close-coupled LNT configuration illustrated in FIG. 1 by introducing external air upstream of the Diesel oxidation catalyst or Diesel particulate filter during the rich combustion period, so that the oxidation of particulate matter can be carried out simultaneously during rich combustion with LNT desulfation and DPF regeneration. Such arrangements embodying the present invention are intended to fall within the scope of the following claims.

Other aspects, features and advantages of the present invention may be obtained from the study of this disclosure and the drawings, along with the appended claims.

What I claim is:

1. A method for controlling exhaust gas flow through a regenerable exhaust gas treatment device for a Diesel engine having a turbocharger comprising a turbine and a compressor, said method comprising:

selectively initially passing exhaust gas produced by said Diesel engine through a first exhaust duct providing a relatively short passageway between an outlet of the turbine and an inlet of the regenerable exhaust gas treatment device and subsequently through at least one of a diesel oxidation catalyst and a diesel particulate filter when it is desired to maintain the internal temperature of the regenerable exhaust gas treatment device, during engine operation, above a predetermined low temperature operating value; and, selectively initially passing exhaust gas produced by said Diesel engine through a second exhaust duct providing a relatively long passageway between the outlet of said turbine and said at least one of a diesel oxidation catalyst and a diesel particulate filter and then subsequently through said regenerable exhaust gas treatment device when it is desired to maintain the internal temperature of the regenerable exhaust gas treatment below a predefined high temperature operating value.

2. The method for controlling exhaust gas flow through a regenerable exhaust gas treatment device, as set forth in claim 1, wherein said exhaust gas treatment device is a $NO_x$ trap and said method includes passing exhaust gas produced by said Diesel engine alternately through said first and said second exhaust ducts to maintain the internal temperature of the regenerable exhaust gas treatment device within a predefined temperature range whereat the conversion efficiency of the $NO_x$ trap is optimized.

3. The method for controlling exhaust gas flow through a regenerable exhaust gas treatment device, as set forth in claim 1, wherein said method includes passing exhaust gas produced by said Diesel engine through said first exhaust duct when the engine is operating in a predefined low to light load condition.

4. The method for controlling exhaust gas flow through a regenerable exhaust gas treatment device, as set forth in claim 1, wherein said method includes passing exhaust gas produced by said Diesel engine through said second exhaust duct when the engine is operating in a predefined medium to high load condition.

5. The method for controlling exhaust gas flow through a regenerable exhaust gas treatment device, as set forth in claim 1, wherein said method includes passing exhaust gas produced by said Diesel engine through said first exhaust duct during cold start-up of the engine and warming up of the engine.

6. The method for controlling exhaust gas flow through a regenerable exhaust gas treatment device, as set forth in claim 1, wherein said method includes passing exhaust gas in a first direction through said regenerable exhaust gas treatment device, and alternately passing exhaust gas in a second direction through said exhaust gas treatment device, said second direction being opposite said first direction.

7. The method for controlling exhaust gas flow through a regenerable exhaust gas treatment device, as set forth in claim 1, wherein said method includes passing at least a portion of the exhaust gas through an exhaust gas cooler prior to passing through said regenerable exhaust gas treatment device.

8. The method for controlling exhaust gas flow through a regenerable exhaust gas treatment device, as set forth in claim 1, wherein said method includes adding controlled amounts of ambient air to the exhaust gas prior to passing through said regenerable exhaust gas treatment device.

9. The method for controlling exhaust gas flow through a regenerable exhaust gas treatment device, as set forth in claim 1, wherein said method includes adding controlled amounts of compressed air to the exhaust gas prior to passing through said regenerable exhaust gas treatment device.

10. The method for controlling exhaust gas flow through a regenerable exhaust gas treatment device, as set forth in claim 1, wherein said regenerable exhaust gas treatment device is a lean $NO_x$ trap.

11. The method for controlling exhaust gas flow through a regenerable exhaust gas treatment device, as set forth in claim 1, wherein said regenerable exhaust gas treatment device is a selective catalytic reduction catalyst.

12. The method for controlling exhaust gas flow through a regenerable exhaust gas treatment device, as set forth in claim 1, wherein said method includes passing exhaust gas through a Diesel oxidation catalyst subsequent to passing the exhaust gas through said regenerable exhaust gas treatment device.

13. The method for controlling exhaust gas flow through a regenerable exhaust gas treatment device, as set forth in claim 1, wherein said method includes adding ambient air to the exhaust gas prior to passing the exhaust gas through said Diesel oxidation catalyst.

14. The method for controlling exhaust gas flow through a regenerable exhaust gas treatment device, as set forth in claim 1, wherein said method includes passing exhaust gas through a Diesel particulate filter subsequent to passing the exhaust gas through said regenerable exhaust gas treatment device.

15. The method for controlling exhaust gas flow through a regenerable exhaust gas treatment device, as set forth in claim 1, wherein said method includes adding ambient air to the exhaust gas prior to passing the exhaust gas through said Diesel particulate filter.

* * * * *